US012287121B2

(12) United States Patent
Dekeyser

(10) Patent No.: US 12,287,121 B2
(45) Date of Patent: Apr. 29, 2025

(54) MODULAR THERMOELECTRIC APPARATUS FOR USE IN MULTIPLE PORTABLE CONTAINERS

(71) Applicant: Igloo Products Corp., Katy, TX (US)

(72) Inventor: Nicholas Dekeyser, Katy, TX (US)

(73) Assignee: Igloo Products Corp., Katy, TX (US)

( * ) Notice: Subject to any disclaimer, the term of this patent is extended or adjusted under 35 U.S.C. 154(b) by 0 days.

(21) Appl. No.: 17/330,811

(22) Filed: May 26, 2021

(65) Prior Publication Data

US 2021/0372639 A1 Dec. 2, 2021

Related U.S. Application Data

(60) Provisional application No. 63/030,671, filed on May 27, 2020.

(51) Int. Cl.

| | |
|---|---|
| ***F24F 5/00*** | (2006.01) |
| ***F25B 21/04*** | (2006.01) |
| ***F25D 19/00*** | (2006.01) |

(52) U.S. Cl.

CPC ..... *F24F 5/0042* (2013.01); *F25B 21/04* (2013.01); *F25D 19/00* (2013.01); *F25D 2400/12* (2013.01)

(58) Field of Classification Search

CPC ..... F24F 5/0042; F25B 21/04; F25D 19/00; F25D 2400/12

See application file for complete search history.

(56) References Cited

U.S. PATENT DOCUMENTS

| | | | |
|---|---|---|---|
| 4,213,310 | A | 7/1980 | Buss |
| D257,934 | S | 1/1981 | Buss |
| D267,444 | S | 1/1983 | Ruxton |
| D268,979 | S | 1/1983 | Ruxton |
| D269,398 | S | 6/1983 | Ruxton |
| D289,597 | S | 5/1987 | Averitt |
| D292,056 | S | 9/1987 | Decker |
| 4,696,412 | A | 9/1987 | McGowan |
| D307,998 | S | 5/1990 | Costello |
| D323,950 | S | 2/1992 | Pleet |
| 5,319,937 | A | 6/1994 | Fritsch |
| D349,007 | S | 7/1994 | Costello |
| D352,420 | S | 11/1994 | Costello |
| D400,053 | S | 10/1998 | Coffee |

(Continued)

FOREIGN PATENT DOCUMENTS

| | | |
|---|---|---|
| AU | 2707277 | 1/1979 |
| AU | 83403 | 9/1981 |

(Continued)

OTHER PUBLICATIONS

US 11,692,755 B2, 07/2023, Wang et al. (withdrawn)

(Continued)

*Primary Examiner* — Larry L Furdge
*Assistant Examiner* — Keith Stanley Myers
(74) *Attorney, Agent, or Firm* — Dinsmore & Shohl LLP

(57) ABSTRACT

A thermoelectric module that is removable from a lid of a thermoelectric portable cooler. The modular thermoelectric apparatus includes a housing and a thermoelectric module disposed within the housing. The housing is coupled to a lower fan shroud with a warm air inlet and a cold air outlet. The housing is adapted to be removably coupled to a lid or a sidewall of a portable cooler.

20 Claims, 7 Drawing Sheets

(56) References Cited

U.S. PATENT DOCUMENTS

| | | | | |
|---|---|---|---|---|
| 5,860,281 | A | 1/1999 | Coffee | |
| 6,260,360 | B1 * | 7/2001 | Wheeler | A01N 1/02 362/371 |
| D486,357 | S | 2/2004 | Leba | |
| D497,517 | S | 10/2004 | Reuter | |
| D500,057 | S | 12/2004 | Reuter | |
| 7,051,550 | B2 | 5/2006 | Roth | |
| D527,226 | S | 8/2006 | Maldonado | |
| D528,368 | S | 9/2006 | Maldonado | |
| D529,344 | S | 10/2006 | Maldonado | |
| 7,140,507 | B2 | 11/2006 | Maldonado | |
| D534,771 | S | 1/2007 | Zorn | |
| 7,344,028 | B2 | 3/2008 | Hanson | |
| 9,366,467 | B2 | 6/2016 | Kiedaisch | |
| D792,486 | S | 7/2017 | Li | |
| D802,028 | S | 11/2017 | Li | |
| D802,029 | S | 11/2017 | Li | |
| D802,630 | S | 11/2017 | Li | |
| D820,049 | S | 6/2018 | Ahlstrom | |
| 10,145,592 | B2 | 12/2018 | Liptak | |
| D836,993 | S | 1/2019 | Meda | |
| D836,994 | S | 1/2019 | Meda | |
| D844,386 | S | 4/2019 | Ahlstrom | |
| 10,562,429 | B2 | 2/2020 | Liptak | |
| D887,788 | S | 6/2020 | Meda | |
| D888,503 | S | 6/2020 | Meda | |
| D894,043 | S | 8/2020 | Meda | |
| D901,986 | S | 11/2020 | Meda | |
| D904,830 | S | 12/2020 | Meda | |
| D907,074 | S | 1/2021 | Yang | |
| D920,743 | S | 6/2021 | Meda | |
| D921,439 | S | 6/2021 | Meda | |
| 11,027,885 | B2 | 6/2021 | Duong | |
| D927,938 | S | 8/2021 | Meda | |
| D929,471 | S | 8/2021 | Meda | |
| D933,449 | S | 10/2021 | Ahlström | |
| D935,280 | S | 11/2021 | Thelin | |
| D953,814 | S | 6/2022 | Thelin | |
| D954,764 | S | 6/2022 | Meda | |
| 11,359,848 | B2 | 6/2022 | Guan | |
| 11,414,238 | B2 | 8/2022 | Ahlström | |
| 11,415,355 | B2 | 8/2022 | Thelin et al. | |
| 11,535,425 | B2 | 12/2022 | Ahlström et al. | |
| 11,623,793 | B2 | 4/2023 | Duong et al. | |
| D985,359 | S | 5/2023 | Ahlström et al. | |
| D995,264 | S | 8/2023 | Ahlström et al. | |
| 11,754,332 | B2 | 9/2023 | Guan et al. | |
| 2004/0089582 | A1 | 5/2004 | Hendrix, Jr. | |
| 2004/0178208 | A1 | 9/2004 | Minh | |
| 2005/0127081 | A1 | 6/2005 | Minh | |
| 2005/0263432 | A1 | 12/2005 | Hanson | |
| 2005/0263527 | A1 | 12/2005 | Maldonado | |
| 2005/0263528 | A1 | 12/2005 | Maldonado | |
| 2005/0279123 | A1 | 12/2005 | Maldonado | |
| 2005/0279124 | A1 | 12/2005 | Maldonado | |
| 2006/0000221 | A1 | 1/2006 | Culp et al. | |
| 2007/0023439 | A1 | 2/2007 | Vaughn | |
| 2007/0119186 | A1 | 5/2007 | Kitchens et al. | |
| 2008/0001373 | A1 | 1/2008 | Vaughn | |
| 2008/0006629 | A1 | 1/2008 | Roth | |
| 2008/0025544 | A1 | 1/2008 | Maldonado | |
| 2011/0182532 | A1 | 7/2011 | Baltus | |
| 2011/0197625 | A1 | 8/2011 | Urban | |
| 2013/0340467 | A1 | 12/2013 | Kiedaisch | |
| 2017/0023290 | A1 | 1/2017 | DeMuth | |
| 2018/0141718 | A1 | 5/2018 | Ahlstrom | |
| 2019/0161240 | A1 | 5/2019 | Ahlstrom | |
| 2020/0062454 | A1 | 2/2020 | Duong | |
| 2020/0140165 | A1 | 5/2020 | Maldonado | |
| 2020/0154894 | A1 * | 5/2020 | Oh | A47C 16/02 |
| 2020/0216229 | A1 | 7/2020 | Weixian | |
| 2020/0217571 | A1 | 7/2020 | Weixian | |
| 2020/0217574 | A1 | 7/2020 | Thelin | |
| 2020/0217575 | A1 | 7/2020 | Thelin | |
| 2020/0217576 | A1 | 7/2020 | Weixian | |
| 2020/0217578 | A1 | 7/2020 | Wang | |
| 2021/0070523 | A1 | 3/2021 | Iyer | |
| 2021/0070528 | A1 | 3/2021 | Iyer | |
| 2021/0071930 | A1 | 3/2021 | Iyer | |
| 2021/0123656 | A1 | 4/2021 | Barros | |
| 2021/0127808 | A1 | 5/2021 | Thelin | |
| 2021/0214123 | A1 | 7/2021 | Iyer | |
| 2021/0229893 | A1 | 7/2021 | Maldonado | |
| 2021/0253305 | A1 | 8/2021 | Duong | |
| 2021/0285710 | A1 | 9/2021 | Barros | |
| 2022/0114847 | A1 | 4/2022 | Emde | |
| 2022/0114853 | A1 | 4/2022 | Emde | |
| 2022/0119152 | A1 | 4/2022 | Blankinship | |
| 2022/0228406 | A1 | 7/2022 | Barros | |
| 2022/0290907 | A1 | 9/2022 | Guan et al. | |
| 2022/0338603 | A1 | 10/2022 | Gamboa et al. | |
| 2022/0355984 | A1 | 11/2022 | Guan et al. | |
| 2022/0388722 | A1 | 12/2022 | Ahlström et al. | |
| 2022/0390163 | A1 | 12/2022 | Thelin et al. | |
| 2023/0030046 | A1 | 2/2023 | Lundqvist et al. | |
| 2023/0032389 | A1 | 2/2023 | Barros et al. | |
| 2023/0034471 | A1 | 2/2023 | Rode et al. | |
| 2023/0131752 | A1 | 4/2023 | Ahlström et al. | |
| 2023/0166901 | A1 | 6/2023 | Harrison et al. | |

FOREIGN PATENT DOCUMENTS

| | | | |
|---|---|---|---|
| AU | 83402 | | 4/1982 |
| AU | 93721 | | 10/1986 |
| AU | 2005262599 | | 1/2006 |
| AU | 2011215734 | | 8/2012 |
| AU | 201712770 | | 5/2017 |
| AU | 201712777 | | 5/2017 |
| AU | 201712780 | | 5/2017 |
| AU | 201712782 | | 5/2017 |
| AU | 201712791 | | 5/2017 |
| AU | 201712799 | | 5/2017 |
| AU | 201712802 | | 5/2017 |
| AU | 201712803 | | 5/2017 |
| AU | 201712785 | | 7/2017 |
| AU | 201716789 | | 11/2017 |
| AU | 201716791 | | 11/2017 |
| AU | 201717667 | | 1/2018 |
| AU | 201717669 | | 1/2018 |
| AU | 201717670 | | 1/2018 |
| AU | 201717674 | | 1/2018 |
| AU | 201717676 | | 1/2018 |
| AU | 201717662 | | 2/2018 |
| AU | 2018205200 | | 8/2018 |
| AU | 201816061 | | 1/2019 |
| AU | 201910011 | | 2/2019 |
| AU | 2015289762 | | 7/2019 |
| AU | 201913598 | | 8/2019 |
| AU | 201913601 | | 8/2019 |
| AU | 201913603 | | 8/2019 |
| AU | 201913604 | | 8/2019 |
| AU | 201913607 | | 8/2019 |
| AU | 201913624 | | 8/2019 |
| AU | 201913626 | | 8/2019 |
| AU | 201913627 | | 8/2019 |
| AU | 201913631 | | 8/2019 |
| AU | 201913633 | | 8/2019 |
| AU | 202012545 | | 6/2020 |
| AU | 202012548 | | 6/2020 |
| AU | 2019284128 | | 7/2020 |
| AU | 2019284129 | | 7/2020 |
| AU | 2019284130 | | 7/2020 |
| AU | 2019284131 | | 7/2020 |
| AU | 2019284133 | | 7/2020 |
| AU | 2019284134 | | 7/2020 |
| AU | 2019302329 | | 1/2021 |
| AU | 2019325454 | | 1/2021 |
| AU | 2019376154 | | 3/2021 |
| AU | 2019371335 | | 5/2021 |
| AU | 2022202482 | A1 | 11/2022 |
| AU | 2021278986 | A1 | 12/2022 |
| CA | 48429 | | 7/1981 |
| CA | 48762 | | 10/1981 |
| CA | 53100 | | 7/1984 |

(56) References Cited

FOREIGN PATENT DOCUMENTS

| | | | |
|---|---|---|---|
| CA | 1281859 | | 3/1991 |
| CA | 2229259 | | 8/1998 |
| CA | 2460597 | | 9/2004 |
| CA | 2570413 | | 1/2006 |
| CA | 2789507 | | 8/2011 |
| CA | 179459 | | 12/2018 |
| CA | 179460 | | 12/2018 |
| CA | 3105713 | | 1/2020 |
| CA | 3106550 | | 2/2020 |
| CA | 3117297 | | 5/2020 |
| CA | 214387 | | 7/2022 |
| CN | 101370699 | | 2/2009 |
| CN | 101431913 | | 5/2009 |
| CN | 106574804 | | 4/2017 |
| CN | 106233083 | | 7/2019 |
| CN | 110191654 | | 8/2019 |
| CN | 305553099 | | 1/2020 |
| CN | 305751278 | | 5/2020 |
| CN | 306079204 | | 9/2020 |
| CN | 112424547 | | 2/2021 |
| CN | 112585416 | | 3/2021 |
| CN | 112955703 | | 6/2021 |
| CN | 112996411 | | 6/2021 |
| CN | 115214988 | A | 10/2022 |
| CN | 115298096 | A | 11/2022 |
| CN | 115667818 | A | 1/2023 |
| DE | 20110247 | | 12/2002 |
| DE | 202004010081 | | 9/2004 |
| DE | 202007001638 | | 5/2007 |
| DE | 202009015164 | | 3/2010 |
| DE | 202013007655 | | 1/2015 |
| DE | 102019200065 | | 1/2019 |
| DE | 102019200067 | | 1/2019 |
| DE | 102019200068 | | 1/2019 |
| DE | 102019200070 | | 1/2019 |
| DE | 112017005901 | | 8/2019 |
| DE | 102019200063 | | 7/2020 |
| DE | 102019200064 | | 7/2020 |
| DE | 212020000770 | U1 | 9/2022 |
| EP | 1765109 | | 3/2007 |
| EP | 2534026 | | 12/2012 |
| EP | 3169947 | | 5/2017 |
| EP | 3821186 | | 5/2021 |
| EP | 3841338 | | 6/2021 |
| EP | 3874211 | | 9/2021 |
| EP | 3876785 | | 9/2021 |
| EP | 4045856 | A1 | 8/2022 |
| EP | 4072950 | A1 | 10/2022 |
| EP | 4079184 | A1 | 10/2022 |
| EP | 4133221 | A1 | 2/2023 |
| ES | 1030365 | | 8/1995 |
| ES | 1030365 | Y | 7/1996 |
| JP | 11006677 | | 1/1999 |
| KR | 1020040080384 | | 9/2004 |
| KR | 1020210040356 | | 4/2021 |
| KR | 1020210048496 | | 5/2021 |
| KR | 1020210084483 | | 7/2021 |
| MX | PA04001493 | | 12/2004 |
| MX | PA06014878 | | 10/2007 |
| WO | 2005123539 | | 12/2005 |
| WO | 2006007266 | | 1/2006 |
| WO | 2006009537 | | 1/2006 |
| WO | 2007016092 | | 2/2007 |
| WO | 2008013973 | | 1/2008 |
| WO | 2011094355 | | 8/2011 |
| WO | 2011100522 | | 8/2011 |
| WO | 2016011072 | | 1/2016 |
| WO | 2018095957 | | 5/2018 |
| WO | 2020013913 | | 1/2020 |
| WO | 2020041236 | | 2/2020 |
| WO | 2020091849 | | 5/2020 |
| WO | 2021050253 | | 3/2021 |
| WO | 2021050255 | | 3/2021 |
| WO | 2021050298 | | 3/2021 |
| WO | 2021086620 | | 5/2021 |
| WO | 2021145971 | | 7/2021 |
| WO | 2021154394 | | 8/2021 |
| WO | 2022081513 | | 4/2022 |
| WO | 2022232513 | A1 | 11/2022 |
| WO | 2023275799 | A1 | 1/2023 |
| WO | 2023009603 | A1 | 2/2023 |
| WO | 2023101721 | A1 | 6/2023 |

OTHER PUBLICATIONS

International Search Report and Written Opinion issued in PCT/US2021/034190, dated Sep. 7, 2021, 10 pages.

Chinese Patent Application No. 202180038231.X titled "Modular Thermoelectric Apparatus for Use in Multiple Portable Containers" filed on Nov. 25, 2022.

Australia Patent Application No. 2021278986 titled "Modular Thermoelectric Apparatus for Use in Multiple Portable Containers" filed on Oct. 27, 2022.

European Patent Application No. 21812690.2 titled "Modular Thermoelectric Apparatus for Use in Multiple Portable Containers" filed on Nov. 11, 2022.

PCT Patent Application No. PCT/US2021/034190 titled "Modular Thermoelectric Apparatus for Use in Multiple Portable Containers" filed on May 26, 2021.

U.S. Appl. No. 63/030,671 titled "Modular Thermoelectric Apparatus for Use in Multiple Portable Containers" filed May 27, 2020.

International Preliminary Report on Patentability issued in PCT Patent Application No. PCT/US2021/034190 mailed on Dec. 8, 2022.

Dometic Product Catalog—Coolers; 2015.

Dometic Product Catalog—Coolers; 2016.

Design U.S. Appl. No. 29/820,716, filed Dec. 23, 2021 titled Container.

Design U.S. Appl. No. 29/820,717, filed Dec. 23, 2021 titled Container.

U.S. Appl. No. 18/332,925, filed Jun. 12, 2023 titled Insulated Container.

Design U.S. Appl. No. 29/840,161, filed May 26, 2022 titled Cooler Fender Frame.

Design U.S. Appl. No. 29/836,642, filed Apr. 28, 2022 titled Half Sleeve Ice Block.

Design U.S. Appl. No. 29/823,704, filed Jan. 19, 2022 titled Insulated Box.

MX Application No. MX/f/2022/002028 filed Jul. 19, 2022 titled Insulated Box.

EU App. No. 009092620 filed Jul. 19, 2022 titled Insulated Box.

U.S. Appl. No. 63/482,354, filed Jan. 31, 2023 titled Modular Container.

* cited by examiner

MODULAR THERMOELECTRIC APPARATUS FOR USE IN MULTIPLE PORTABLE CONTAINERS

CROSS-REFERENCE TO RELATED APPLICATIONS

The present application claims the benefit of priority to U.S. Provisional Application No. 63/030,671, entitled "MODULAR THERMOELECTRIC APPARATUS FOR USE IN MULTIPLE PORTABLE CONTAINERS," filed on May 27, 2020, which is incorporated herein by reference in its entirety.

BACKGROUND

Typically, food, beverages and other contents to be kept cool may be placed in a portable cooler along with plenty of ice. Polystyrene foam or other insulation disposed within the portable cooler can facilitate keeping the contents cool for a longer time period than if the insulation were not provided, but the temperature of the contents may still rise as the ice melts. In some situations, it can be desirable to keep the contents cool for an extended period of time without the need to add ice. Additionally, it can be desirable to keep contents cool in a portable container that may not have ice or insulation. Differences exist in the abilities of various portable coolers, portable containers, and insulation to keep contents cold or cool, which can be problematic when a more uniform experience for cooling is preferred.

SUMMARY

Disclosed herein are various thermoelectric portable coolers and modular thermoelectric apparatuses to address the aforementioned deficiencies. In various aspects, a thermoelectric portable cooler can include a modular thermoelectric apparatus with a housing that is sized and shaped to be received by an opening formed along a lid or a sidewall of the thermoelectric portable cooler. The modular thermoelectric apparatus can include a thermoelectric module disposed within the housing. The modular thermoelectric apparatus can also include a lower fan and an upper fan. Some embodiments provide that a warm air inlet and a cold air outlet are adapted to be thermally coupled to a cavity of the thermoelectric portable coolers. In operation, the lower fan can pull or divert warm air through the warm air inlet toward a cold side of the thermoelectric module. The warm air can become cold air and exit through the cold air outlet. The upper fan can push hot air away from the hot side of the thermoelectric module through the hot air outlet.

In one embodiment, among others, a thermoelectric portable cooler includes a body with a base, and a sidewall extending orthogonally away from a perimeter of the base defining a cavity therein. The thermoelectric portable cooler includes a lid that at least partially is removable from distal ends of the sidewall of the body, and encloses the cavity of the body. The lid defines an opening extending therethrough. There is a modular thermoelectric apparatus inserted into the opening of the lid to provide cooling within the cavity. The modular thermoelectric apparatus is removable from the lid.

In some aspects, the modular thermoelectric apparatus further includes a thermal insulator defining an opening, and an extender having an upper surface and a lower surface. The extender is disposed within the opening of the thermal insulator. The thermoelectric module includes an upper plate and a lower plate, with the lower plate disposed on and in thermal contact with the upper surface of the extender.

In some examples, the modular thermoelectric apparatus includes an upper heat sink disposed on and in thermal contact with the upper plate of the thermoelectric module, and a lower heat sink disposed on and in thermal contact with the lower surface of the extender. In some aspects, the modular thermoelectric apparatus includes an upper fan disposed above the thermal insulator adjacent the upper heat sink, a lower fan disposed below the thermal insulator adjacent the lower heat sink, and a housing enclosing the thermal insulator, the extender, the thermoelectric module, the upper heat sink, the lower heat sink, the upper fan, and the lower fan. The housing includes an upper surface having an ambient air inlet disposed above the upper fan, a hot air outlet disposed above the upper heat sink, and a wiring connection for providing power to the modular thermoelectric apparatus, and a cold air outlet disposed adjacent the lower heat sink and positioned within the cavity of the body.

In another embodiment, a thermoelectric portable cooler includes a body comprising a base and a sidewall extending orthogonally away from a perimeter of the base defining a cavity therein. The sidewall defines an opening extending therethrough. The thermoelectric portable cooler includes a lid that at least partially is removable from distal ends of the sidewall of the body and encloses the cavity of the body. In some aspects, the thermoelectric portable cooler includes a modular thermoelectric apparatus inserted into the opening of the sidewall to provide cooling within the cavity. The modular thermoelectric apparatus is removable from the sidewall.

In another embodiment, among others, a modular thermoelectric apparatus includes a thermoelectric module disposed within a housing. The thermoelectric module has a cold side and a hot side. In some aspects, the housing is sized and shaped to be received by an opening formed along a lid or a sidewall of a portable cooler. The housing is adapted to be removably coupled to the lid or the sidewall.

In some examples, the housing is coupled to an upper fan shroud comprising a hot air outlet. The hot air outlet is thermally coupled to the hot side of the thermoelectric module. The housing is coupled to a lower fan shroud comprising a warm air inlet and a cold air outlet. The cold air outlet is thermally coupled to the cold side of the thermoelectric module.

In some aspects, at least one of: the warm air inlet or the cold air outlet is adapted to be thermally coupled to a cavity of the portable cooler. Some embodiments provide that the warm air inlet and the cold air outlet are adapted to be thermally coupled to the cavity of the portable cooler.

In some embodiments, the housing being sized and shaped to be received by the opening includes an upper main housing portion that is adapted to suspend the warm air inlet and the cold air outlet in the cavity when the housing is received by the opening. In some examples, the upper main housing portion includes a wall that forms a lip that is adapted to support the modular thermoelectric apparatus when the housing is received by the opening. The wall can be configured into a shape that is complementary to an upper portion of the lid.

In some examples, the modular thermoelectric apparatus includes an upper fan housed within the upper fan shroud and a lower fan housed within the lower fan shroud. The lower fan can be configured to pull or divert warm air through the warm air inlet toward the cold side of the thermoelectric module. The lower fan shroud can be adapted to allow the warm air to flow toward the cold side to become cold air and exit through the cold air outlet. Some embodiments provide that the upper fan is configured to push hot air away from the hot side of the thermoelectric module through the hot air outlet. The warm air inlet and the lower fan can be circular in shape.

In some embodiments, the modular thermoelectric apparatus includes a lower heat sink that is disposed within the lower fan shroud, and an extender that is disposed within a lower housing portion of the housing. The extender can be thermally coupled to a lower plate of the cold side of the thermoelectric module. The extender can be configured to transport the heat away from the lower heat sink into the extender and to the thermoelectric module. In some aspects, the modular thermoelectric apparatus includes a thermal insulator that is disposed within the lower fan shroud. The thermal insulator defines an opening into which the extender is inserted.

Some embodiments provide that the extender includes a top surface that is in thermal contact with the lower plate of the thermoelectric module, and a lower surface that is in thermal contact with the lower heat sink. An upper heat sink can be enclosed within the housing and thermally coupled to the extender through an upper plate of the hot side of the thermoelectric module. The hot air outlet can be rectangular in shape to match a width of the upper heat sink.

Other apparatuses, methods, features, and advantages of the present disclosure will be or become apparent to one with skill in the art upon examination of the following drawings and detailed description. It is intended that all such additional apparatuses, methods, features, and advantages be included within this description, be within the scope of the present disclosure, and be protected by the accompanying claims.

In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

The foregoing and other features and aspects of the invention are best understood with reference to the following description of certain exemplary embodiments, when read in conjunction with the accompanying drawings, which are not necessarily drawn to scale, and wherein.

DETAILED DESCRIPTION OF EXEMPLARY EMBODIMENTS

Figure 1A:
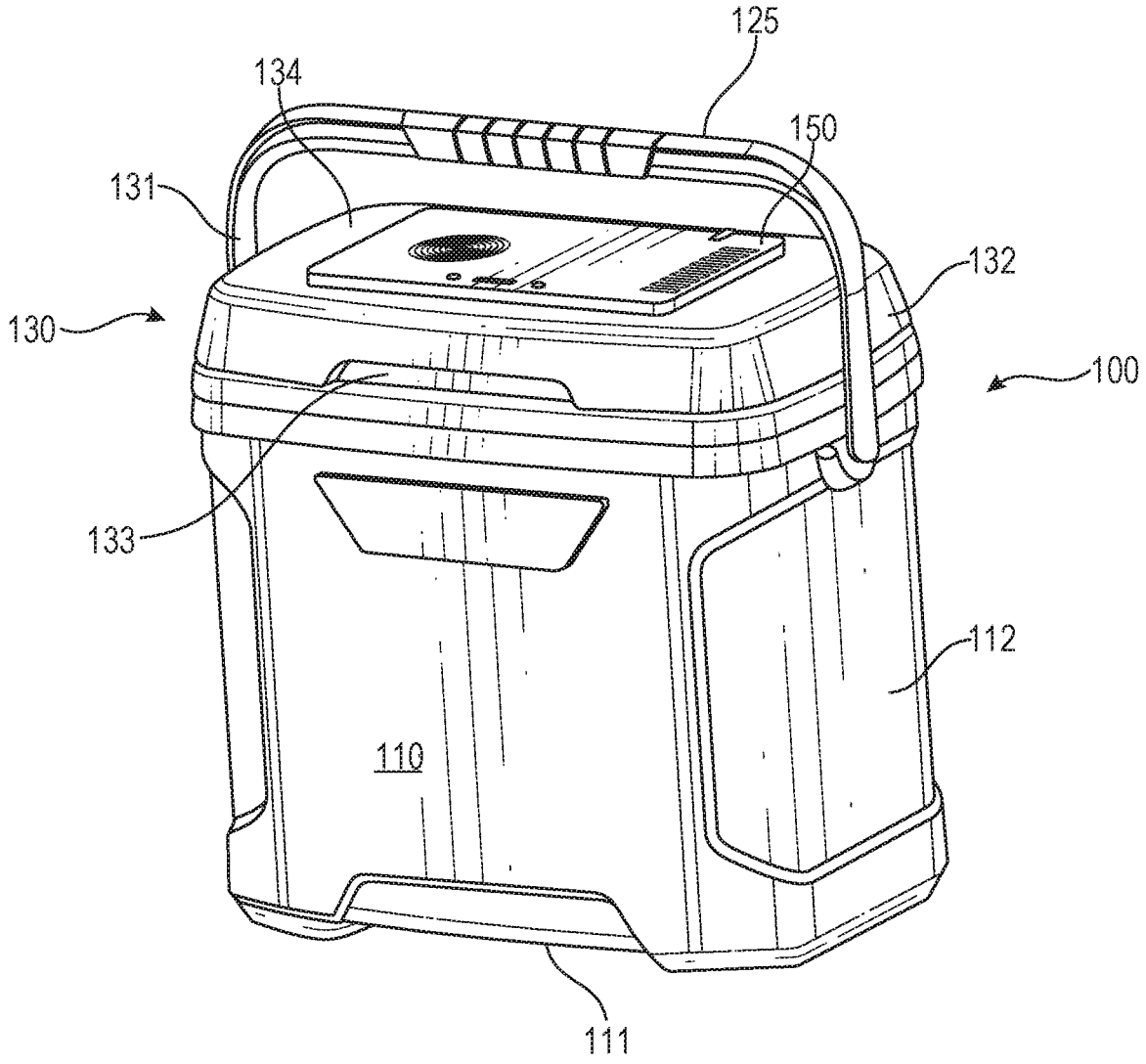
FIGS. 1A-1D show perspective views of several thermoelectric portable containers using a modular thermoelectric apparatus in accordance with different exemplary embodiments.
Figure 1B:
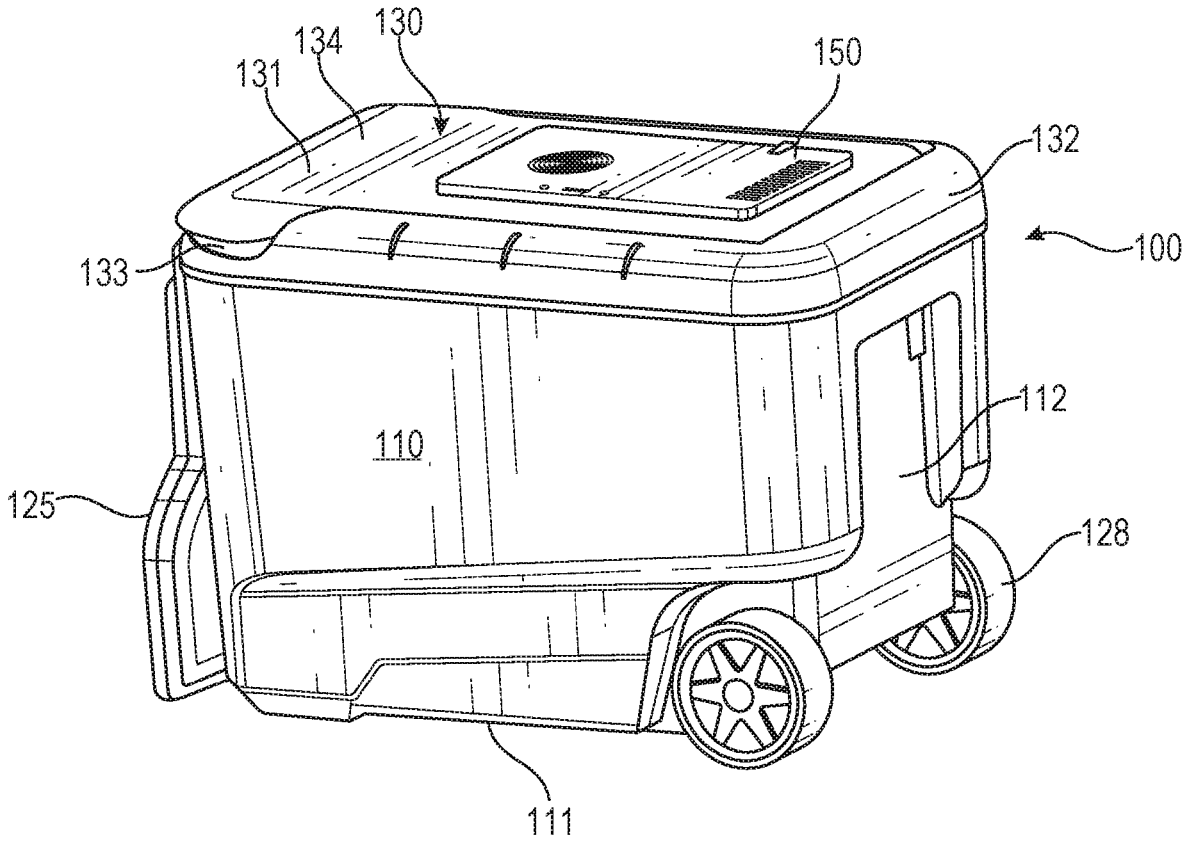
Figure 1C:
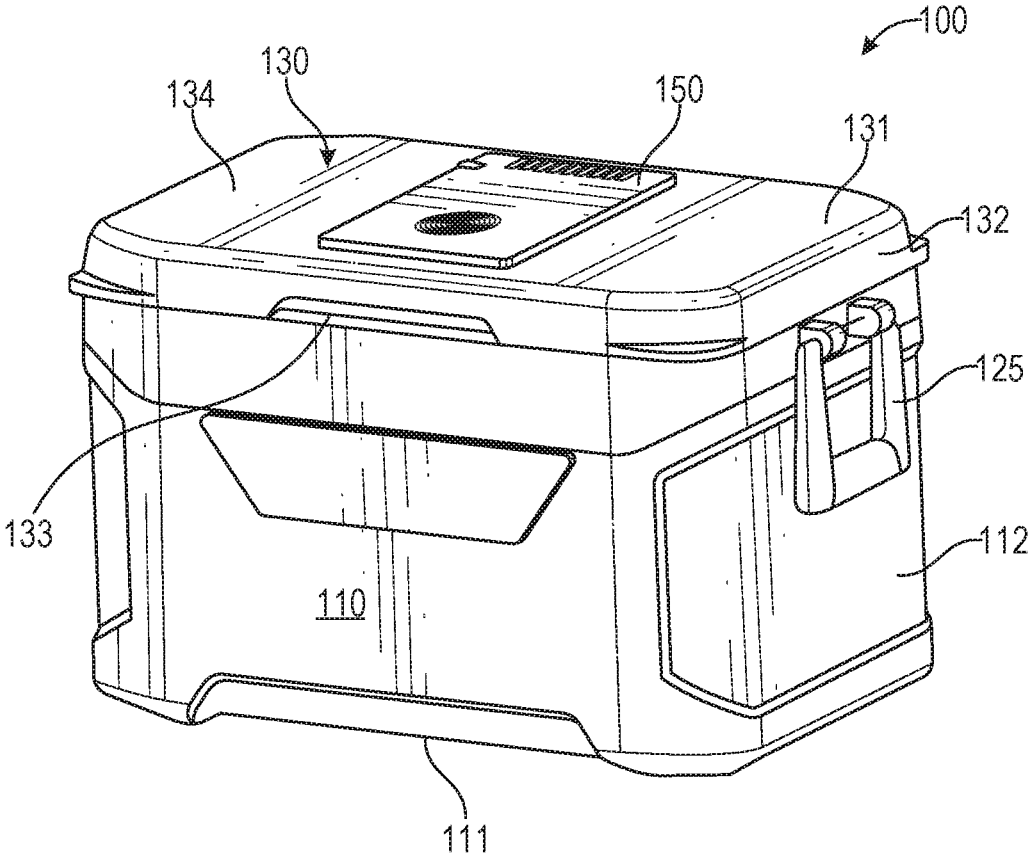
Figure 1D:
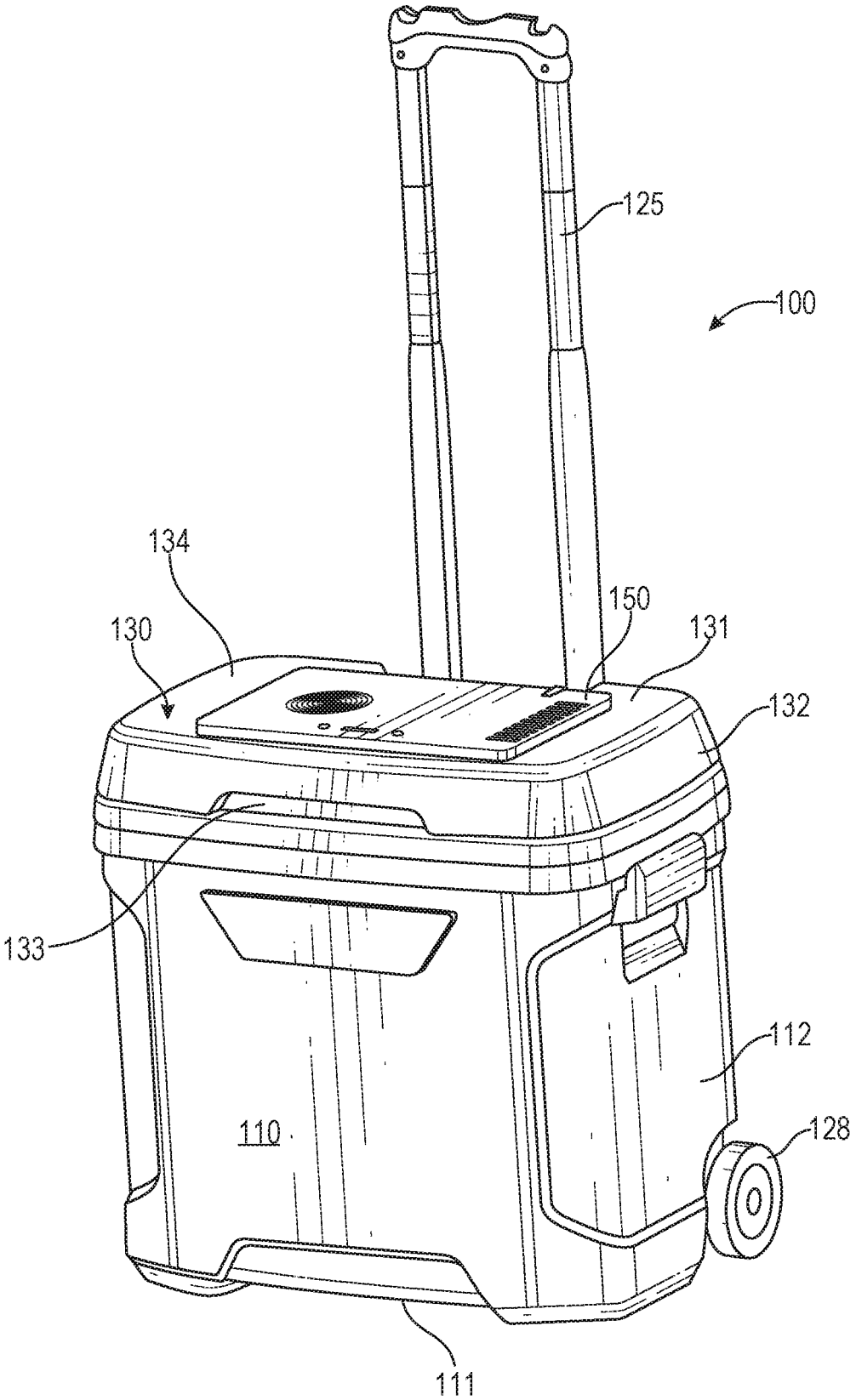

The exemplary embodiment discussed herein is directed to various aspects (e.g., methods, systems, devices) of a thermoelectric apparatus, and more particularly to a modular thermoelectric apparatus used in cooling multiple portable containers. In certain exemplary embodiments, the lid may be coupled to the top of the body in any number of ways, such as by use of a hinge and/or a latch or it may be friction-fitted. Further, the modular thermoelectric apparatus may be of a different size or shape than described herein and may be coupled to the lid in a different manner than described herein. Further, the body of the thermoelectric portable container, or thermoelectric portable cooler, may be in one or more of a number of different cooler sizes with various lengths, widths, heights, geometrical and non-geometrical shapes and/or capacities. Further, in certain exemplary embodiments, the thermoelectric portable container, or thermoelectric portable cooler, may be fabricated using different colors, accents, and/or different personalizations, such as by laser etching or silk screening across one or more of its surfaces. Further, in certain exemplary embodiments, the thermoelectric portable cooler, or thermoelectric portable cooler, may be fabricated in various different materials, such as rubber, plastics, stainless steel, other polymers, and other metals in one or more fabricated parts of the thermoelectric portable cooler. Further, the thermoelectric portable cooler may include other known features including but not limited to wheels, lights, various handle types, and speakers.

Exemplary embodiments of the thermoelectric portable cooler will now be described more fully hereinafter with reference to the accompanying drawings, in which an exemplary embodiment of the thermoelectric apparatus and the thermoelectric portable cooler is shown. The thermoelectric apparatus and the thermoelectric portable cooler may, however, be embodied in many different forms and should not be construed as limited to the exemplary embodiment set forth herein. Rather, this exemplary embodiment is provided so that this disclosure will be thorough and complete, and will fully convey the scope of the thermoelectric apparatus and the thermoelectric portable cooler to those or ordinary skill in the art. Like, but not necessarily the same, elements in the various figures are denoted by like reference numerals for consistency.

FIGS. 1A-1D show perspective views of several thermoelectric portable containers 100, or thermoelectric portable coolers 100, using a modular thermoelectric apparatus 150 in accordance with exemplary embodiments. The modular thermoelectric apparatus 150 is modular in the sense that it can be removed from a lid 130 of one thermoelectric portable cooler 100 and inserted into a lid 130 of another thermoelectric portable cooler 100, even though the shape and size of the thermoelectric portable coolers 100 can be different. Although examples depicted show the modular thermoelectric apparatus 150 being coupled to the lid 130 of the thermoelectric portable coolers 100, the modular thermoelectric apparatus 150 can be coupled to one or more sidewalls 112 of the thermoelectric portable coolers 100. According to FIGS. 1A-1D, the thermoelectric portable cooler 100 includes a body 110, a lid 130, and a modular thermoelectric apparatus 150.

The body 110 can be a rectangular prism in shape according to the exemplary embodiments shown but may be shaped in any other geometric or non-geometric shape, such as cylindrical in shape, in other embodiments. The capacity of the body 110 may be small enough where a person can easily lift using one or more handles 125 that is coupled to the body 110, yet in other embodiments, the capacity of the body 110 may be too much for a person to lift. The body 110 may accommodate one or more wheels 128 coupled adjacently near the bottom of the body 110, in addition to the one or more handles 125, to facilitate moving the thermoelectric portable cooler 100 from one location to another location when full of contents, either fluids, other items, or a combination of the aforementioned. The body 110 can be fabricated using a plastic material, such as a heavy duty, thick-walled plastic. In other embodiments, the body 110 can be fabricated using a rubberized material, a metal or metal alloy material, or some other suitable material or combination of materials used in fabricating coolers. The body 110 may be single-walled or may be doubled-walled with an insulating layer (not shown) disposed therebetween. The body 110 may also include a liner (not shown) disposed within the body 110. The body 110 includes a base 111 and a sidewall 112 extending substantially orthogonal from the perimeter of the base 111 to form a body opening (not shown) at the distal ends of the sidewall 112, thereby defining a cavity (not shown) within the body 110 that is fluidly or thermally coupled to the body opening (not shown). According to certain exemplary embodiments, the body opening (not shown) is rectangular in shape and the cavity (not shown) is a rectangular prism in shape.

The lid 130 is rectangular in shape according to the exemplary embodiment but may be shaped in any other geometric or non-geometric shape to cover the shape of the body opening in other embodiments. According to some exemplary embodiments, the lid 130 is fabricated using a plastic material, such as a heavy duty, thick-walled plastic; yet, in other embodiments, the lid 130 can be fabricated using a rubberized material, a metal or metal alloy material, or some other suitable material or combination of materials used in fabricating cooler lids. The lid 130 may be single-walled or may be doubled-walled with an insulating layer (not shown) disposed therebetween. The lid 130 includes a base 131 and a sidewall 132 extending substantially orthogonal from the base 131. The lid 130 can be shaped to couple with the body 110 and cover the body's opening and cavity. The lid 130 can be entirely removable from the body 110 or may be rotatably pivoted about a hinge and/or latch (not shown) that is used to couple one edge of the lid 130 to one edge of the distal ends of the body's sidewall 112. The lid 130 can be removable from distal ends of the sidewall 112.

According to some exemplary embodiments, the lid 130 includes one or more lid recesses 133 formed along the sidewall 132 of the lid 130. In exemplary embodiments where two lid recesses 133 are formed in the lid 130, the lid recesses 133 can be generally formed approximately 180 degrees apart. The lid recesses 133 can be formed to facilitate a user in opening and decoupling the lid 130 from at least a portion of the body 110 to gain access to the inner portion of the body 110, which can be for filling up or emptying the contents from within the body 110. Further, in certain exemplary embodiments, the lid's base 131 includes an outer surface 134 that faces away from the body's base 111 when the lid 130 is coupled to the body 110. The outer surface 134 can be generally flat or planar and allows for a user to place items on top of the lid 130 when the lid 130 is coupled to the body 110. Alternatively, the outer surface 134 may include other features, such as drink holders (not shown). The lid 130 is coupled and decoupled to or from the body 110 by friction fit and either pressing down on the lid 130 or pulling up on the lid 130. Alternatively, the lid 130 can be coupled or decoupled from the body 110 through rotation where the body 110 and the lid 130 include threads (not shown), such as when the body 11 and the lid 130 are circular or cylindrical, according to other embodiments. Further, latches, hinges or other fasteners (not shown) may be used for coupling and decoupling the lid 130 to and from the body 110 according to other embodiments.

Figure 2:
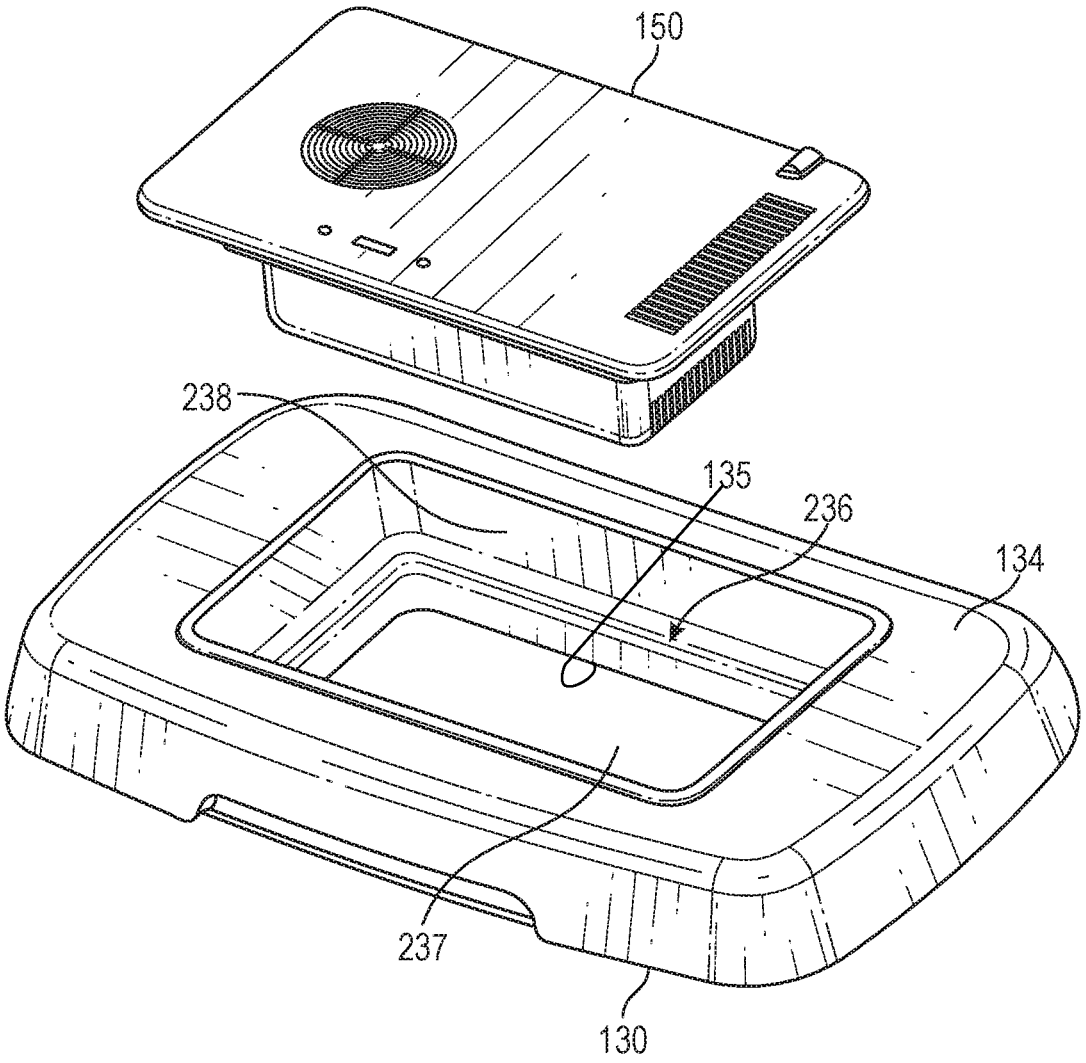
FIG. 2 shows an exploded perspective view of a lid and the modular thermoelectric apparatus of the thermoelectric portable containers of FIG. 1A in accordance with an exemplary embodiment.

The modular thermoelectric apparatus 150 can be coupled to the lid 130 as shown in FIGS. 1A-1D. FIG. 2 shows an exploded perspective view of the lid 130 and the modular thermoelectric apparatus 150 of the thermoelectric portable containers 100 of FIG. 1A in accordance with an exemplary embodiment, which shows how the modular thermoelectric apparatus 150 can be coupled to the lid 130 of the thermoelectric portable container 100. According to FIGS. 1A-2, the lid 130 defines an opening 236 which extends from the outer surface 134 of the lid 130 to an inner surface 135 of the lid 130. The opening 236 includes an upper end 238 and a lower end 237. A size of the lower end 237 can be smaller than the size of the upper end 238. The modular thermoelectric apparatus 150 can be configured to drop into the lid 130 from the lid's upper surface 134 as it proceeds towards the lid's lower surface 135. The lid 130 defines only one opening 236 according to the embodiment, however, according to other embodiments, the lid 130 can be larger in size and define a plurality of openings 236, where each such opening 236 has a modular thermoelectric apparatus 150 disposed therein. The modular thermoelectric apparatus 150 is described in further detail with respect to the description provided in conjunction with FIGS. 3 and 4.

Figure 3:
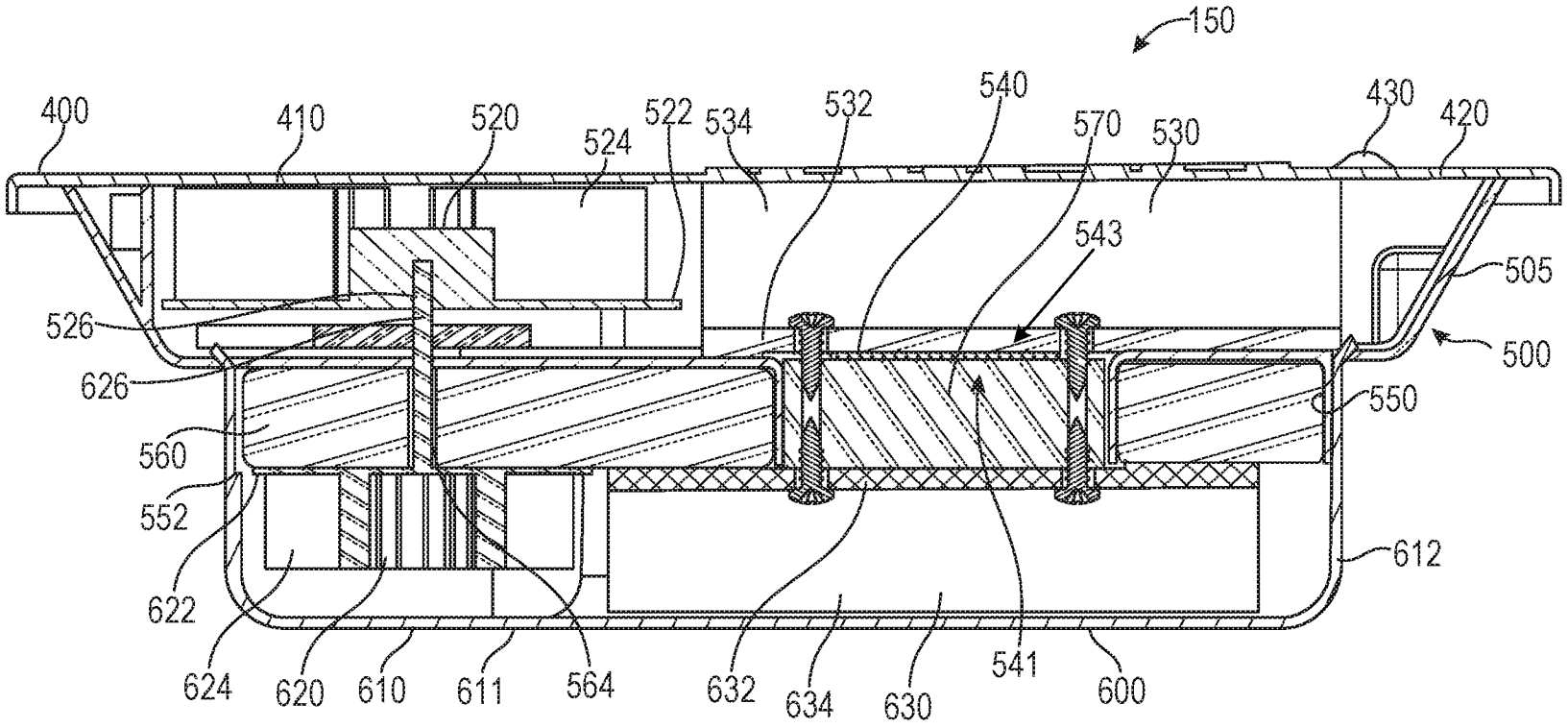
FIG. 3 is a cross-sectional view of the modular thermoelectric apparatus of FIG. 2 in accordance with the exemplary embodiment.
Figure 4:
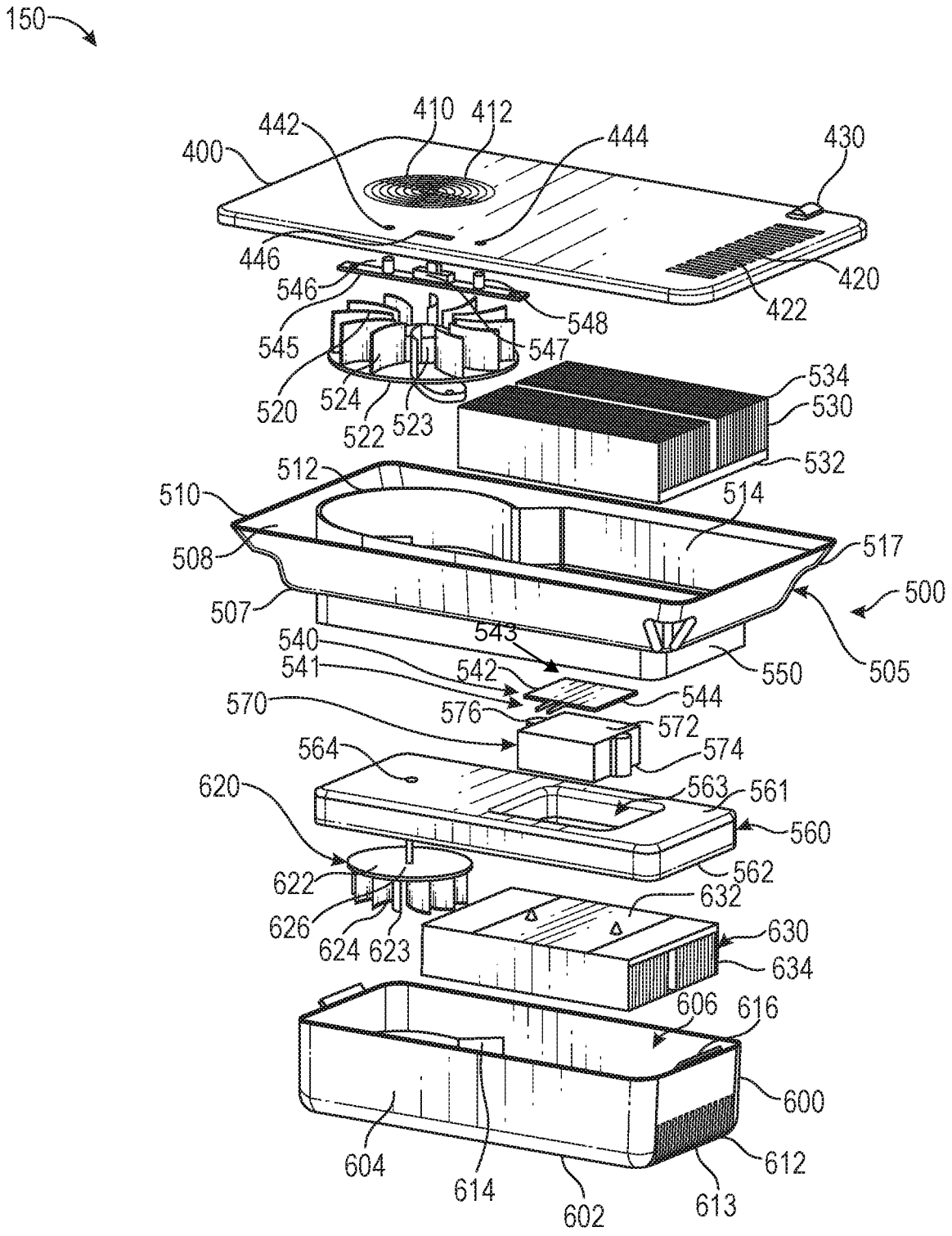
FIG. 4 is an exploded perspective view of the modular thermoelectric apparatus of FIG. 2 in accordance with the exemplary embodiment; and The drawings illustrate only an exemplary embodiment of the modular thermoelectric apparatus which can be used in several container types and is therefore not to be considered limiting of its scope, as the invention may admit to other equally effective embodiments.

FIG. 3 is a cross-sectional view of the modular thermoelectric apparatus 150 of FIG. 2 in accordance with the exemplary embodiment. FIG. 4 is an exploded perspective view of the modular thermoelectric apparatus 150 of FIG. 2 in accordance with the exemplary embodiment. Referring to FIGS. 3 and 4, the modular thermoelectric apparatus 150 can include an upper fan shroud 400, a main housing 500, and a lower fan shroud 600, which can collectively form the outer housing of the modular thermoelectric apparatus 150. The main housing 500 can be sized and shaped to be received by an opening formed along a lid 130 or a sidewall 112 of the portable cooler 100. The main housing 500 can be adapted to be removably coupled to the lid 130 or the sidewall 112. The main housing 500 can include an upper main housing portion 505 and a lower main housing portion 550 (or lower housing portion 550) which can be formed as a single component. The upper fan shroud 400 can be coupled to the top edges of the upper main housing portion 505, while the lower fan shroud 600 can be coupled to the lower end of the upper main housing portion 505 and can be disposed about and around the lower main housing portion 550. Although this embodiment illustrates one way in which the upper fan shroud 400 and the lower fan shroud 600 are coupled to the main housing 500, other embodiments may have the upper fan shroud 400 and the lower fan shroud 600 coupled to the main housing 500 in a different manner, or use fewer or greater components than that shown without departing from the scope and spirit of the embodiment. There are additional components included within the modular thermoelectric apparatus 150, some of which are disposed within the upper main housing portion 505 below the upper fan shroud 400, some of which are disposed within the lower main housing portion 550, and some of which are disposed within the lower fan shroud 600 below the lower main housing portion 550.

The components disposed within the upper main housing portion 505 below the upper fan shroud 400 can include an upper fan 520, an upper heat sink 530, a thermoelectric module 540 such as a Peltier module, and a control printed circuit board assembly ("PCBA") 545. The components disposed within the lower main housing portion 550 can include a thermal insulator 560 and an extender 570. The components disposed within the lower fan shroud 600 below the lower main housing portion 550 can include a lower fan 620 and a lower heat sink 630.

The upper fan shroud 400 can be fabricated from plastic or some other suitable material known to those people having ordinary skill in the art. The upper fan shroud 400 includes an ambient air inlet 410, a hot air outlet 420, and a wiring connection 430. The ambient air inlet 410 can be circular in shape to match the shape of the upper fan 520 which it rests above when the modular thermoelectric apparatus 150 is assembled. The ambient air inlet 410 can be shaped differently in other embodiments. The ambient air inlet 410 can include an ambient inlet grill 412 or some similar type structure so that the ambient air inlet 410 is not merely an opening and there is a prevention of objects falling into the upper fan 520.

The hot air outlet 420 can be rectangular in shape to match the width of the upper heat sink 530 for at least a portion of its length. The hot air outlet 420 can rest above the upper heat sink 530 when the modular thermoelectric apparatus 150 is assembled. The hot air outlet 420 can be shaped differently in other embodiments. Further, the hot air outlet 420 can include a hot outlet grill 422 or some similar type structure so that the hot air outlet 420 is not merely an opening and there is a prevention of objects falling into the upper heat sink 530.

The wiring connection 430 can be an elevated port formed at one edge of the upper fan shroud 400. The wiring connection 430 can be configured to receive a plug (not shown) for powering the modular thermoelectric apparatus 150. Generally, the wiring connection 430 can be adapted to receive current from a DC power source or from an AC power source with an adapter for converting the alternating current into direct current at some point between the power source and the wiring connection 430. In alternative embodiments, the modular thermoelectric apparatus 150 can be designed to operate on alternating current. The modular thermoelectric apparatus 150 can operate on direct current so that it can be cooled in a controlled environment, such as from a car cigarette lighter for instance, such as when people go camping and need to have cool beverages or food in the thermoelectric portable cooler 100. The wiring connection 430 can be electrically coupled to the control PCBA 545, the thermoelectric module 540, the upper fan 520, and the lower fan 620. Optionally, the upper fan shroud 400 may include a first opening 442, a second opening 444, and a switch opening 446 when the control PCBA 545 is used, which is described in further detail in conjunction with the description of the control PCBA 545.

The control PCBA 545 can be a circuit board that includes a first LED 546, a second LED 547, and a switch 548. The control PCBA 545 can be coupled to the underside of the upper fan shroud 400. The first LED 546 is insertable into the upper fan shroud's first opening 442, while the switch 548 is insertable into the upper fan shroud's switch opening 446, while the second LED 547 is insertable into the upper fan shroud's second opening 444. According to some exemplary embodiments, the first LED 546 emits a red light, while the second LED 547 emits a blue light; however, in other exemplary embodiments, the first and second LEDS 546, 547 emit a different color light that is not the same color as each other. The switch 548 is a three-position switch which turns the first LED 546 on when the switch 548 is in the first position, turns first and second LEDs 546, 547 off when in the second position, or neutral position, and turns the second LED 547 on when the switch 548 is in the third position. When the switch 548 is in the first position and the first LED 546 is on, the thermoelectric module 540 operates in a manner to heat the contents of the thermoelectric portable cooler 100 (FIG. 1A). When the switch 548 is in the second position and the first LED 546 and the second LED 547 are off, the thermoelectric module 540 may not activate and the contents of the thermoelectric portable cooler 100 (FIG. 1A) can be neither heated nor cooled. When the switch 548 is in the third position and the second LED 547 is on, the thermoelectric module 540 can operate in a manner to cool the contents of the thermoelectric portable cooler 100 (FIG. 1A). In the embodiments where the control PCBA 545 is not present, the thermoelectric module 540 can operate in an on/off manner when current is either supplied to the wiring connection 430 and the contents of the thermoelectric portable cooler 100 (FIG. 1A) are cooled.

The main housing 500 includes the upper main housing portion 505 and the lower main housing portion 550, which can be fabricated as a single component or as multiple components coupled to one another. The main housing 500 is fabricated from plastic but can be fabricated using other materials that would be known to those people having ordinary skill in the art. The upper main housing portion 505 includes an outer wall 510 and an inner wall 512. According to the exemplary embodiment, the inner wall 512 shares one of its sides with the outer wall 510; however, in other exemplary embodiments, the inner wall 512 may not share a side with the outer wall 510. The upper main housing portion 505 includes a base 507 where the outer wall 510 extends in an upward direction from the perimeter of the base 507. The outer wall 510 extends upwardly and outwardly from the base such that an opening 508 can be defined at the distal ends of the outer wall 510. The opening 508 can be dimensioned to be larger than the base 507. The outer wall 510 also form a lip 511 along its distal ends which facilitate supporting the modular thermoelectric apparatus 150 within the lid 130 (FIG. 2) once inserted therein. The lip 511 can be adapted to support the modular thermoelectric apparatus 150 when the housing 500 is received by the opening 508.

The outer wall 510 can be configured into a complementary shape to the upper portion of the lid's opening 236 (FIG. 2). The inner wall 512 extends in an upward direction from within the area of the base 507 and defines a cavity 514 extending therethrough which can be shaped to accommodate the insertion of the upper fan 520 and the upper heat sink 530 therein. Although described below in further detail, the thermal insulator 560 can be inserted into the lower main housing portion 550 to form a floor for the cavity 514 for which the upper fan 520 and the upper heat sink 530 may be supported. The lower main housing portion 550 extends downwardly from the interior of the base 507 and defines a cavity 552 therein so that the thermal insulator 560 and the extender 570 can be inserted therein from the underside of the lower main housing portion 550. The thermal insulator 560 can define an opening into which the extender 570 is inserted.

The upper fan 520 can include a base 522 and a plurality of blades 524 extending orthogonally upwards from the base 522 and radially from a vertically oriented centerline axis of the upper fan 520. According to some exemplary embodiments, the base 522 can be optional and the plurality of blades 524 extend outwardly from a vertically oriented cylinder 523 positioned about the vertically oriented centerline axis of the upper fan 520. In some embodiments, the plurality of blades 524 are curved; however, in other embodiments, the plurality of blades 524 are planar. The upper fan 520 includes an aperture 526 extending inwardly from its underside to facilitate rotation of the upper fan 520 which is described in more detail below in conjunction with the description of the lower fan 620. The upper fan 520 can be inserted into a portion of the cavity 514 from the top end of the main housing 500.

The upper heat sink 530 can be rectangular in shape but may be shaped in another geometric or non-geometric shape in other exemplary embodiments. The upper heat sink 530 can include a base 532 and a plurality of fins 534 extending orthogonally upwards where each fin 534 is parallel with one another and separated from one another by a distance to allow passage of air from the upper fan 520. The fins 534 can be fabricated using aluminum, copper or some other known heat dissipating material which may be extruded, die cast or formed by some other known methods. Alternatively, the upper heat sink 530 may be heat pipes used for dissipating the heat from the air entering from the upper fan 520. The base 532 can be fabricated using a thermally conductive material such as aluminum or copper. The upper heat sink 530 can be inserted into another portion of the cavity 514 from the top end of the main housing 500 and positioned adjacent the upper fan 520 such that the fins 534 receive air from the upper fan 520.

The thermal insulator 560 can be fabricated using an insulating material and includes an upper surface 561 and a lower surface 562. The thermal insulator 560 defines an opening 563 extending from the upper surface 561 to the lower surface 562, which can be dimensioned to have the extender 570 inserted therein. The thickness of the thermal insulator 560 can be similar to the thickness of the extender 570. The thermal insulator 560 also includes a pin opening 564 extending from the upper surface 561 to the lower surface 562. The thermal insulator 560 can be dimensioned to be insertable into the lower main housing portion 550 from its underside.

The extender 570 can be fabricated using a thermally conductive material, such as aluminum or copper, and can include a top surface 572 and a bottom surface 574. The extender 570 can be dimensioned to be inserted into the opening 563 of the thermal insulator 560. The extender 570 can be designed to transport the heat from the lower heat sink 630 into the extender 570 and to the thermoelectric module 540. The extender 570 can include at least one coupling joint 576 for coupling the lower heat sink 630 to the extender's bottom surface 574 and coupling the upper heat sink 530 to the extender's top surface 572. The extender 570 can be configured to transport heat away from the lower heat sink 630 into the extender 570 and to the thermoelectric module 540.

The thermoelectric module 540 can have a cold side 541 and a hot side 543. Accordingly, the thermoelectric module 540 can include an upper plate 542, a lower plate 544, and alternating p-type and n-type semiconductor pillars or pellets (not shown) placed thermally in parallel to each other and electrically in series between the upper plate 542 and the lower plate 544. The semiconductor pillars or pellets (not shown) can be joined to the thermally conducting plates 542, 544 on its sides. When a voltage is applied to the free ends of the two semiconductors (not shown), there is a flow of DC current across the junction of the semiconductors (not shown) causing a temperature difference between the two plates 542, 544. The lower plate 544 can be cooler than the upper plate 542 and absorb heat, which can be transported by the semiconductors (not shown) to the upper plate 542. The thermoelectric module 540 can be dimensioned to rest in contact with the extender 570, where the lower plate 544 can be in contact with the top surface 572 of the extender 570 and the upper plate 542 can be in contact with the base 532 of the upper heat sink 530. The lower plate 544 can be disposed on and in thermal contact with the upper surface of the extender 570.

In some examples, the upper heat sink 530 can be thermally coupled to the hot side 543 of the thermoelectric module 540. The upper heat sink 530 can be disposed on and in thermal contact with the upper plate 542 of the thermoelectric module 540. The lower heat sink 630 can be thermally coupled to the cold side 541 of the thermoelectric module 540. The lower heat sink 630 can be disposed on and in thermal contact with the lower surface of the extender 570. The hot air outlet 420 of the upper fan shroud 400 can be thermally coupled to the hot side 543 of the thermoelectric module 540. The extender 570 can be disposed within a lower main housing portion 550 of the housing 500 and thermally coupled to the lower plate 544 of the cold side 541 of the thermoelectric module 540. The upper heat sink 530 can be enclosed within the main housing 500, and thermally coupled to the extender 570 through an upper plate 542 of the hot side 543 of the thermoelectric module 540.

The lower fan 620 can include a base 622 and a plurality of blades 624 extending orthogonally downwards from the base 622 and radially from a vertically oriented centerline axis of the lower fan 620. According to some exemplary embodiments, the base 622 can be optional and the plurality of blades 624 extend outwardly from a vertically oriented cylinder 623 positioned about the vertically oriented centerline axis of the lower fan 620. In some embodiments, the plurality of blades 624 are curved. In other embodiments, the plurality of blades 624 can be planar. The lower fan 620 can include a rod 626 extending orthogonally from the base in an upwardly and opposite direction from the blades 624. The rod 626 can be positioned along the centerline axis of the vertically oriented cylinder 623 or lower fan 620. The rod 626 of the lower fan 620 can be inserted through the thermal insulator's pin opening 564 from the thermal insulator's lower surface 562 through the thermal insulator's upper surface 561 and into the upper fan's aperture 526, which facilitates rotation of the lower fan 620 and the upper fan 520. The lower fan 620 can be coupled to the upper fan 520 and can be disposed within a portion of a cavity 606 formed within the lower fan shroud 600 and below the lower surface 562 of the thermal insulator 560 once the lower fan shroud 600 can be coupled to the main housing 500. The lower fan 620 can be configured to pull or divert warm air through the warm air inlet 610 toward the cold side 541 of the thermoelectric module 540.

The lower heat sink 630 can be rectangular in shape but may be shaped in another geometric or non-geometric shape in other exemplary embodiments. The lower heat sink 630 can include a base 632 and a plurality of fins 634 extending orthogonally downwards where each fin 634 can be parallel with one another and separated from one another by a distance to allow passage of air from the lower fan 620. The fins 634 can be fabricated using aluminum, copper or some other known heat dissipating material which may be extruded, die cast or formed by some other known methods. Alternatively, the lower heat sink 630 may be heat pipes used for dissipating the heat from the air entering from the lower fan 620. The base 632 can be fabricated using a thermally conductive material such as aluminum or copper. The lower heat sink 630 can be coupled to the extender's coupling joint 576 and can be disposed within a portion of the cavity 606 formed within the lower fan shroud 600 once the lower fan shroud 600 can be coupled to the main housing 500. The lower heat sink 630 can be positioned adjacent the lower fan 620 such that the fins 634 receive air from the lower fan 620.

The lower fan shroud 600 can be fabricated from plastic or some other suitable material known to those people having ordinary skill in the art. The lower fan shroud 600 can include a base 602 and sidewalls 604 extending vertically about the base 602 to define a cavity 606 therein. The lower fan shroud 600 also includes a warm air inlet 610, a cold air outlet 612, a warm air guide vane 614, and one or more tabs 616. The warm air inlet 610 can be circular in shape to match the shape of the lower fan 620 which it rests below when the modular thermoelectric apparatus 150 is assembled; however, the warm air inlet 610 can be shaped differently in other embodiments. The warm air inlet 610 can include a warm air inlet grill 611 or some similar type structure so that the warm air inlet 610 is not merely an opening providing access to the lower fan 620. The cold air outlet 612 can be rectangular in shape to match the width of the lower heat sink 630 for at least a portion of its length. The cold air outlet 612 rests to the side of the lower heat sink 630 when the modular thermoelectric apparatus 150 is assembled and forms a part of at least one of the sidewalls 604. However, the cold air outlet 612 can be shaped differently in other embodiments. The cold air outlet 612 can include a cold outlet grill 613 or some similar type structure so that the cold air outlet 612 is not merely an opening and there is no direct access to the lower heat sink 630. The warm air guide vane 614 can extend orthogonally upwards from the lower fan shroud's base 602 within the cavity 606. The warm air guide vane 614 can be curved to fit around the lower fan 620 and then extends away toward the lower heat sink 630 to guide the cool air from the lower fan 620 to the lower heat sink 630. The tabs 616 can be formed at the distal ends of opposing sidewalls 604 and can be used to couple the lower fan shroud 600 to the main housing 500. The cold air outlet 612 of the lower fan shroud 600 can be thermally coupled to the cold side 541 of the thermoelectric module 540. In some examples, at least one of the warm air inlet 610 or the cold air outlet 612 is adapted to be thermally coupled to a cavity of the thermoelectric portable cooler 100. The upper main housing portion 505 can be adapted to suspend the warm air inlet 610 or the cold air outlet 612 in the cavity when the housing 500 is received by the opening. The lower fan shroud 600 can be adapted to allow the warm air to flow (or divert the warm air) toward the cold side 541 to become cold air and exit through the cold air outlet 612. In operation, the upper fan 520 can be configured to push or divert hot air away from the hot side 543 of the thermoelectric module 540 through the hot air outlet 420.

The assembly of the modular thermoelectric apparatus 150 can be described while referring to FIGS. 3 and 4. Accordingly, while the extender 570 is inserted into the opening 563 of the thermal insulator 560, the lower heat sink 630 can be coupled to the extender 570 along the bottom surface 574 of the extender 570 using screws or other fasteners. The lower heat sink 630 can be located adjacent the lower surface 562 of the thermal insulator 560. The thermal insulator 560 can be disposed within the lower main housing portion 550 through the underside of the main housing 500. Once the thermal insulator 560 is positioned within the lower main housing portion 550, the lower plate 544 of the thermoelectric module 540 is positioned on the top surface 572 of the extender 570 from above the thermal insulator 560 and through the upper main housing portion's cavity 514. The upper heat sink 530 can be coupled to the extender 570 along the upper plate 542 of the thermoelectric module 540 using screws or other fasteners through the upper main housing portion's cavity 514. The lower fan 620 has its rod 626 inserted through a pin opening 564 in the thermal insulator 560. The upper fan 520 can be coupled to the rod 626 from above the thermal insulator 560 and through the upper main housing portion's cavity 514 by inserting the end of the rod 626 into the upper fan's aperture 526. In the embodiments where the control PCBA 545 is used, the control PCBA 545 can be coupled to the underside of the upper fan shroud 400 where the first LED 546, the second LED 547, and the switch 548 are inserted into the first opening 442, the switch opening 446, and the second opening 444, respectively. The upper fan shroud 400 can be coupled to the distal ends of the upper main housing portion's outer wall 510. The lower fan shroud 600 can be coupled to the base 507 of the upper main housing portion 505 using the one or more tabs 616 and can be disposed about the thermal insulator 560 once coupled. The components of the modular thermoelectric apparatus 150 are assembled as shown in FIGS. 3 and 4.

FIG. 4 depicts the airflow patterns of the modular thermoelectric apparatus 150. The following description describes the airflow patterns once the modular thermoelectric apparatus 150 is installed within the sidewall 112 or the lid 130 (FIG. 2). When the modular thermoelectric apparatus 150 is turned on, the upper fan 520 and the lower fan 620 can be operational and rotating, while a voltage differential is created at the thermoelectric module 540 causing the upper plate 542 to get hot and the lower plate 544 to get cold. The upper fan 520 can pull ambient air, located externally from the thermoelectric portable cooler 100 (FIG. 1A), through ambient air inlet 410. The ambient air then flows from the upper fan 520 towards the upper heat sink 530 and through the fins 534, where it pulls additional heat from those fins 534. The additional heat within those fins 534, e.g., from the upper plate 542 of the thermoelectric module 540, can be transferred to the upper heat sink's base 532 and then to the fins 534. The ambient air can become hot air at the fins 534 and can exit the modular thermoelectric apparatus 150 through the hot air outlet 420. The lower fan 620 can pull or divert the warm air, located internally within the thermoelectric portable cooler 100 (FIG. 1A) below the lid 130 (FIG. 2), through the warm air inlet 610. The warm air then can flow from the lower fan 620 towards the lower heat sink 630 and through the fins 634, where the heat from the warm air can be transferred to the base 632 of the lower heat sink 630, either directly or through the fins 634, then through the extender 570, then through the thermoelectric module's lower plate 544, then through the thermoelectric module's upper plate 542, and then to the ambient air that becomes hot air via the upper heat sink 530. The warm air then becomes cold air at the fins 634 and exits the modular thermoelectric apparatus 150 through the cold air outlet 612. The cold air outlet 612 can be located below the lid 130 (FIG. 2) and hence the cold air enters the cavity of the thermoelectric portable cooler 100 (FIG. 1A), which stores the contents to be cooled. According to certain exemplary embodiments, the use of one modular thermoelectric apparatus 150 will provide cooling to the contents within the thermoelectric portable cooler 100 (FIG. 1A) that is about 36° F. cooler than the ambient air. It can be preferred that the ambient air temperature be about 76° F. or cooler when trying to cool the contents of the thermoelectric portable cooler 100 (FIG. 1A) to less than 40° F., which is a food safe temperature. However, the ambient air can be any temperature above 76° F. when not attempting to keep certain foods or drinks at or below the food safe temperature.

Accordingly, many modifications and other embodiments set forth herein will come to mind to one skilled in the art to which modular thermoelectric apparatuses and/or thermoelectric portable coolers pertain having the benefit of the teachings presented in the foregoing descriptions and the associated drawings. Therefore, it is to be understood that these modular thermoelectric apparatuses and/or thermoelectric portable coolers are not to be limited to the specific embodiment disclosed and that modifications and other embodiments are intended to be included within the scope of this application. Although specific terms are employed herein, they are used in a generic and descriptive sense only and not for purposes of limitation.

Disjunctive language such as the phrase "at least one of X, Y, or Z," unless specifically stated otherwise, is otherwise understood with the context as used in general to present that an item, term, etc., can be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

For any figure shown and described herein, one or more of the components may be omitted, added, repeated, and/or substituted. Accordingly, embodiments shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein. In the various embodiments described herein, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The terms "a," "an," and "the" are intended to include plural alternatives, e.g., at least one. The terms "including", "with", and "having", as used herein, are defined as comprising (i.e., open language), unless specified otherwise.

Although the thermoelectric module 540 and the control PCBA 545 can comprise or be executed by general purpose hardware that is specially configured or programmed as discussed above, as an alternative the same can be embodied in dedicated hardware or a combination of software/general purpose hardware and dedicated hardware. If embodied in dedicated hardware, each can be implemented as a circuit or state machine that employs any one of or a combination of a number of technologies. These technologies can include, but are not limited to, discrete logic circuits having logic gates for implementing various logic functions upon an application of one or more data signals, application specific integrated circuits (ASICs) having appropriate logic gates, field-programmable gate arrays (FPGAs), or other components. Such technologies are generally well known by those skilled in the art and, consequently, are not described in detail herein.

It is emphasized that the above-described examples of the present disclosure are merely examples of implementations to set forth for a clear understanding of the principles of the disclosure. Many variations and modifications can be made to the above-described examples without departing substantially from the spirit and principles of the disclosure. All such modifications and variations are intended to be included herein within the scope of this disclosure.

What is claimed is:

1. A thermoelectric portable cooler, comprising:

a body comprising a base, and a sidewall extending orthogonally away from a perimeter of the base defining a cavity therein;

a lid at least partially being removable from distal ends of the sidewall of the body and enclosing the cavity of the body, the lid defining an opening extending therethrough, said opening having an outer perimeter at an outer lid surface, and an inner perimeter at an inner lid surface, and wherein said outer perimeter is larger than said inner perimeter, and further comprising a step located between said outer perimeter and said inner perimeter;

a housing disposed through said opening in said lid and into said cavity of said body below an inner surface of said lid;

a modular thermoelectric apparatus contained within said housing distinctly from said lid, said modular thermoelectric apparatus in fluid communication with the opening of the lid to provide cooling within the cavity, said modular thermoelectric apparatus having an upper fan and a lower fan axially aligned with said upper fan, an upper heat sink laterally spaced from said upper fan and a lower heat sink laterally spaced from said lower fan;

an upper fan shroud and lower fan shroud, said upper fan shroud positioned above said housing and said lower fan shroud positioned below said housing, said upper fan shroud having a larger size than said lower fan shroud;

said upper fan shroud engaging said lid and raised relative to a remainder of said lid, said lower shroud facing said cavity;

said upper heat sink and said upper fan enclosed by said upper fan shroud, and said lower heat sink and said lower fan enclosed by said lower fan shroud;

wherein said housing is removably coupled to the lid.

2. The thermoelectric portable cooler of claim 1, wherein the modular thermoelectric apparatus further comprises:

a thermal insulator defining an opening;

an extender having an upper surface and a lower surface, the extender disposed within said opening of the thermal insulator; and a thermoelectric module comprising an upper plate and a lower plate, the lower plate disposed on and in thermal contact with the upper surface of the extender.

3. The thermoelectric portable cooler of claim 2, wherein the modular thermoelectric apparatus further comprises:

the upper heat sink disposed on and in thermal contact with the upper plate of the thermoelectric module; and the lower heat sink disposed on and in thermal contact with the lower surface of the extender.

4. The thermoelectric portable cooler of claim 3, wherein the modular thermoelectric apparatus further comprises:

the upper fan disposed above the thermal insulator adjacent the upper heat sink;

the lower fan disposed below the thermal insulator adjacent the lower heat sink and having a rod that is inserted through a pin hole defined by the thermal insulator, the rod being coupled to the upper fan; and said housing enclosing the thermal insulator, the extender, the thermoelectric module, the upper heat sink, the lower heat sink, the upper fan, and the lower fan, the housing comprising said upper fan shroud having an ambient air inlet disposed above the upper fan, a hot air outlet disposed above the upper heat sink, and a wiring connection for providing power to the modular thermoelectric apparatus, and a cold air outlet disposed adjacent the lower heat sink and positioned within the cavity of the body.

5. A thermoelectric portable cooler, comprising:

a body comprising a base and a sidewall extending orthogonally away from a perimeter of the base defining a cavity therein, the sidewall defining an opening extending therethrough;

a lid at least partially being removable from distal ends of the sidewall of the body and enclosing the cavity of the body, said lid comprising an opening having a first perimeter and a second perimeter wherein said second perimeter is smaller than said first perimeter, and further comprising a step disposed between said first perimeter and said second perimeter; and a modular thermoelectric apparatus in fluid communication with the opening of the sidewall to provide cooling within the cavity, said modular thermoelectric apparatus having a housing which encloses a first heat sink and a second heat sink, said first heat sink and said second heat sink being offset from a first fan and a second fan, respectively within said housing;

an outer air shroud engaging said sidewall and raised relative to a remainder of said sidewall, an inner air shroud facing said cavity, said housing located between said outer and inner air shrouds, said outer air shroud being larger than said inner air shroud and wherein said housing engages said step;

said first heat sink and said first fan enclosed by said outer air shroud, and said second heat sink and said second fan enclosed by said inner air shroud;

wherein the modular thermoelectric apparatus is removably coupled to the sidewall.

6. A modular thermoelectric apparatus, comprising:

a thermoelectric module disposed within a housing, the thermoelectric module having a cold side and a hot side;

the housing sized and shaped to be received by an opening formed along a lid of a portable cooler, the housing containing the thermoelectric module distinctly from said lid, and the housing adapted to be removably coupled to the lid, the housing coupled to:

an upper fan shroud comprising a hot air outlet, the hot air outlet thermally coupled to the hot side of the thermoelectric module; and a lower fan shroud comprising a warm air inlet and a cold air outlet, the cold air outlet thermally coupled to the cold side of the thermoelectric module;

said upper fan shroud and said lower fan shroud enclosing said housing, said upper fan shroud being larger than said lower fan shroud;

said opening comprising an outer perimeter and an inner perimeter which is smaller than said outer perimeter, a step disposed between said outer perimeter and said inner perimeter wherein said housing engages said step;

wherein a first fan and a second fan are axially aligned, and a first heat sink and a second heat sink are offset from a common axis of said first fan and said second fan, and further wherein said housing encloses said first fan and said first heat sink and said second fan and said second heat sink.

7. The modular thermoelectric apparatus of claim 6, wherein at least one of: the warm air inlet or the cold air outlet is adapted to be thermally coupled to a cavity of the portable cooler.

8. The modular thermoelectric apparatus of claim 7, wherein the housing being sized and shaped to be received by the opening comprises:

an upper main housing portion that is adapted to suspend the warm air inlet and the cold air outlet in the cavity when the housing is received by the opening.

9. The modular thermoelectric apparatus of claim 8, wherein the warm air inlet and the cold air outlet are adapted to be thermally coupled to the cavity of the portable cooler.

10. The modular thermoelectric apparatus of claim 8, wherein the upper main housing portion includes a wall that forms a lip that is adapted to support the modular thermoelectric apparatus when the housing is received by the opening.

11. The modular thermoelectric apparatus of claim 10, wherein the wall is configured into a shape complementary to an upper portion of the lid.

12. The modular thermoelectric apparatus of claim 6, further comprising:

an upper fan housed within the upper fan shroud and a lower fan housed within the lower fan shroud.

13. The modular thermoelectric apparatus of claim 12, wherein:

the lower fan is configured to pull warm air through the warm air inlet toward the cold side of the thermoelectric module, wherein the lower fan shroud is adapted to allow the warm air to flow toward the cold side to become cold air and exit through the cold air outlet.

14. The modular thermoelectric apparatus of claim 12, wherein:

the upper fan is configured to push hot air away from the hot side of the thermoelectric module through the hot air outlet.

15. The modular thermoelectric apparatus of claim 6, wherein the warm air inlet and the lower fan shroud are circular in shape.

16. The modular thermoelectric apparatus of claim 6, wherein:

a lower heat sink of said first heat sink and said second heat sink is disposed within the lower fan shroud; and an extender is disposed within a lower housing portion of the housing and thermally coupled to a lower plate of the cold side of the thermoelectric module, the extender being configured to transport heat away from the lower heat sink into the extender and to the thermoelectric module.

17. The modular thermoelectric apparatus of claim 16, wherein a thermal insulator is disposed within the lower fan shroud, the thermal insulator defining an opening into which the extender is inserted.

18. The modular thermoelectric apparatus of claim 16, wherein the extender comprises a top surface in thermal contact with the lower plate of the thermoelectric module, and a lower surface in thermal contact with the lower heat sink.

19. The modular thermoelectric apparatus of claim 16, wherein an upper heat sink of said first heat sink and said second heat sink is enclosed within the housing and thermally coupled to the extender through an upper plate of the hot side of the thermoelectric module.

20. The modular thermoelectric apparatus of claim 19, wherein the hot air outlet is rectangular in shape to match a width of the upper heat sink.

* * * * *